US010033117B1

(12) United States Patent
Moore et al.

(10) Patent No.: US 10,033,117 B1
(45) Date of Patent: Jul. 24, 2018

(54) CONNECTING INSERT FOR A TERMINAL ASSEMBLY

(71) Applicant: TE CONNECTIVITY CORPORATION, Berwyn, PA (US)

(72) Inventors: Richard Frank Moore, Dauphin, PA (US); Robert Neil Mulfinger, York Haven, PA (US); Richard Vincent Lucente, Mechanicsburg, PA (US); Kevin Michael Thackston, York, PA (US); Brian Todd Klinger, Harrisburg, PA (US); Nicholas Paul Ruffini, York, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/412,393

(22) Filed: Jan. 23, 2017

(51) Int. Cl.
*H01R 4/20* (2006.01)
*H01R 4/2495* (2018.01)

(52) U.S. Cl.
CPC ..... *H01R 4/203* (2013.01); *H01R 4/20* (2013.01); *H01R 4/2495* (2013.01)

(58) Field of Classification Search
CPC ..... H01R 4/203; H01R 4/2495; H01R 4/20
USPC ..... 439/421, 424, 423, 877, 879, 882, 585, 439/607.48, 607.5, 730, 741
See application file for complete search history.

(56) References Cited

U.S. PATENT DOCUMENTS 3,594,713 A * 7/1971 Thoman ..... H01R 4/206 439/730
3,955,044 A * 5/1976 Hoffman ..... H01R 4/203 174/84 C
5,749,756 A * 5/1998 Vockroth ..... H01R 4/203 174/84 C
7,160,156 B2 * 1/2007 Holliday ..... H01R 4/5025 439/585
9,196,971 B2 * 11/2015 Gery ..... H01R 4/203
9,608,427 B2 * 3/2017 Fulponi ..... H02G 15/043

* cited by examiner

*Primary Examiner* — Renee Luebke
*Assistant Examiner* — Paul Baillargeon

(57) ABSTRACT

A terminal assembly includes a terminal having a wire barrel and a mating segment configured to be mated to a mating component. The terminal assembly includes a shuttle assembly configured to be coupled to an end of a wire. The shuttle assembly includes a connecting insert defining a wire chamber configured to receive an exposed conductor of the wire. The connecting insert has a retention tab extending into the wire chamber. The retention tab is configured to interfere with and retain the wire in the wire chamber. The connecting insert is received in the wire barrel of the terminal and the connecting insert is configured to be crimped between the wire barrel of the terminal and the exposed conductor of the wire when the wire barrel is crimped around the connecting insert and the wire.

20 Claims, 4 Drawing Sheets

CONNECTING INSERT FOR A TERMINAL ASSEMBLY

BACKGROUND OF THE DISCLOSURE

Embodiments of the present disclosure generally relate to connecting inserts for terminal assemblies.

Terminal assemblies are used to provide power and/or data signals between various components. A typical wire assembly includes an insulating cover that surrounds portions of a conductive wire. A distal end of the insulating cover may be stripped in order to expose a portion of the conductive wire so that the exposed portion of the conductive wire may contact conductive portions of a terminal.

In order to electrically and mechanically connect the wire to the terminal, portions of the wire and the terminal may be crimped together. Typically, the terminal is crimped directly to the wire. However, problems with oxidation may occur on the wire and/or the terminal. For example, problems with oxidation may occur at the interface between a terminal and a wire in the presence of water. Some known terminal assemblies provide a seal that is crimped at the wire barrel of the terminal. However, the electrical interface between the terminal and the wire may be degraded if oxidation is present.

Some known terminal assemblies utilize a perforated insert between the terminal and the wire that is crimped between the terminal and the wire. The perforated insert causes a wiping action at the interface with the terminal and/or the wire during crimping to remove oxides and forming a solid electrical bond between the wire and terminal. However, assembly of the terminal assemblies using the perforated inserts is difficult. For example, the perforated insert is typically oversized to allow the wire to be inserted into the insert. The perforated insert does not remain positioned on the end of the wire and may shift relative to the wire as the wire and the insert are inserted into the wire barrel of the terminal, which may lead to the wire being only partially loaded into the terminal and an ineffective crimp.

Accordingly, a need exists for a simpler and more efficient connecting insert for connecting a conductive wire to a terminal.

BRIEF DESCRIPTION OF THE DISCLOSURE

In one embodiment, a terminal assembly is provided including a terminal having a wire barrel and a mating segment configured to be mated to a mating component. The terminal assembly includes a shuttle assembly configured to be coupled to an end of a wire. The shuttle assembly includes a connecting insert defining a wire chamber configured to receive an exposed conductor of the wire. The connecting insert has a retention tab extending into the wire chamber. The retention tab is configured to interfere with and retain the wire in the wire chamber. The connecting insert is received in the wire barrel of the terminal and the connecting insert is configured to be crimped between the wire barrel of the terminal and the exposed conductor of the wire when the wire barrel is crimped around the connecting insert and the wire.

In another embodiment, a terminal assembly is provided including a terminal having a wire barrel and a mating segment configured to be mated to a mating component and a shuttle assembly configured to be coupled to an end of a wire. The shuttle assembly includes a connecting insert and a seal member extending from the connecting insert configured to be coupled to an insulating cover of the wire. The connecting member defines a wire chamber configured to receive an exposed conductor of the wire forward of the insulating cover. The connecting insert has a retention tab extending into the wire chamber configured to interfere with and retain the wire in the wire chamber. The connecting insert and the seal member are received in the wire barrel of the terminal. The connecting insert is configured to be crimped between the wire barrel of the terminal and the exposed conductor of the wire when the wire barrel is crimped around the connecting insert and the wire. The seal member is configured to be crimped between the wire barrel of the terminal and the insulating cover of the wire when the wire barrel is crimped around the seal member and the wire.

In a further embodiment, a connecting insert configured to be crimped to a wire is provided that includes a body having a wall defining a wire chamber configured to receive an exposed conductor of the wire. The wall has a plurality of openings therethrough configured to wipe against a conductor of the wire when the body is crimped to the wire. Retention tabs extend from the wall into the wire chamber. The retention tabs are configured to interfere with and retain the wire in the wire chamber until the body is crimped to the wire. The retention tabs are compressed against the wire when the body is crimped to the wire.

DETAILED DESCRIPTION OF THE DISCLOSURE

Figure 1:
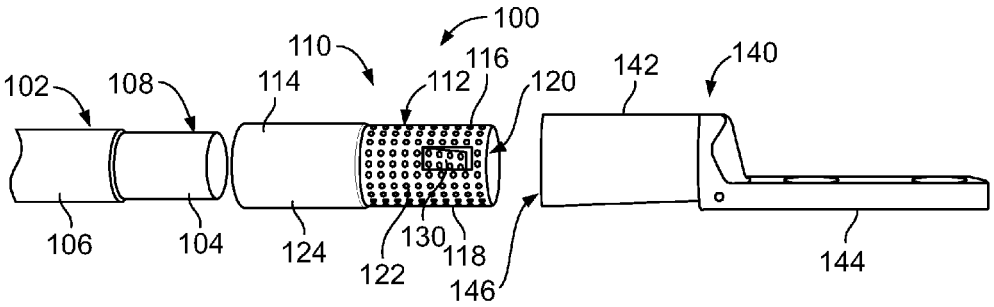
FIG. 1 is an exploded view of a terminal assembly including a terminal configured to be terminated to a wire assembly formed in accordance with an exemplary embodiment.

FIG. 1 is an exploded view of a terminal assembly 100 in accordance with an exemplary embodiment. The terminal assembly 100 includes a wire 102, a shuttle assembly 110 configured to be coupled to an end of the wire 102, and a terminal 140 configured to be terminated to the shuttle assembly 110 and the wire 102. The wire 102 includes an internal conductor 104 that is covered by an insulating cover 106. The conductor 104 may be formed of a conductive metal, such as copper, aluminum, or the like. The conductor 104 may be a solid core conductor or a stranded wire. The insulating cover 106 is formed of an insulating material, such as rubber, plastic, or the like. The insulating cover 106 may form a jacket of the wire 102. The wire 102 may include other layers such as a wire braid, an outer jacket, and the like. A portion of the insulating cover 106 is stripped in order to expose an end 108 of the conductor 104. In an exemplary embodiment, the shuttle assembly 110 and the terminal 140 are configured to be crimped to the end 108 of the wire 102.

The shuttle assembly 110 includes a connecting insert 112 configured to be terminated to the conductor 104 of the wire 102 and the terminal 140. The connecting insert 112 is configured to be positioned between the wire 102 and the terminal 140 and is crimped to the wire 102 when the terminal 140 is crimped to the wire 102. Optionally, the shuttle assembly 110 includes a seal member 114 for sealing to the insulating cover 106. The seal member 114 may be crimped by the terminal 140 around the insulating cover 106. Optionally, the seal member 114 is integral with the connecting insert 112. Alternatively, the seal member 114 is a separate component from the connecting insert 112 connected to the connecting insert 112 to form a single piece structure configured to be received on the wire 102 and received in the terminal 140.

In an exemplary embodiment, the connecting insert 112 is an oxide-permeating mesh structure. For example, during a crimping operation, the oxide-permeating mesh structure may break through aluminum oxides of the exposed end 108 of the conductor 104 and/or the terminal 140. The connecting insert 112 may wipe against the conductor 104 and/or the terminal 140 when the terminal 140 is crimped to the end 108 of the wire 102. The connecting insert 112 includes a main body 116 having an exterior wall 118, which may be a cylindrical wall. The main body 116 may include an end cap provided at the end of the wall 118; however, the end may be open rather than being capped in alternative embodiments. The wall 118 may surround and define a chamber 120 configured to receive the end 108 of the wire 102. In an exemplary embodiment, the cylindrical wall 118 includes a plurality of openings 122, such as holes, perforations, slots, or the like. The openings 122 define a mesh type structure. The openings 122 may be generally uniformly dispersed along the wall 118. The openings 122 may be stamped into the wall 118. Optionally, the openings 122 may be formed through the end cap, when provided, as well. The openings 122 may have sharp edges formed around the openings 122 when the openings 122 are stamped. The sharp edges may dig into and/or wipe against the conductor 104 and/or the terminal 140 when crimped.

The seal member 114 may be a sealing sleeve, such as formed of rubber, silicone rubber, or the like, that is secured over an outer portion of an end of the connecting insert 112. The seal member 114 includes a main wall 124 that defines an internal passage therethrough. The internal passage is open at both ends of the seal member 114.

The shuttle assembly 110 may be formed as a combined structure. For example, the seal member 114 may be slid onto an end of the connecting insert 112 and secured thereto through an interference fit. Optionally, the seal member 114 may be adhesively secured to the connecting insert 112. In at least one embodiment, the connecting insert 112 may include one or more detent members that snapably engage reciprocal member(s) of the seal member 114. In at least one embodiment, the seal member 114 may be overmolded onto an end of the connecting insert 112. In at least one other embodiment, fluid sealing material may be deposited on end of the connecting insert 112 and then cooled to form the seal member 114. The shuttle assembly 110 may be formed as a combined structure, and shipped to an end user.

The insulating cover 106 of the wire 102 is stripped to expose the end 108 of the conductor 104 such that the exposed end 108 is sized and shaped to be inserted into the chamber 120 of the shuttle assembly 110. The wire 102 is axially aligned with the shuttle assembly 110 and urged into the seal member 114 until the exposed end 108 of the conductor 104 is within the chamber 120. When loaded, the end of the insulating cover 106 is covered by the seal member 114. In an exemplary embodiment, the connecting insert 112 includes a retention tab 130 used to axially secure the connecting insert 112 on the wire 102. For example, the retention tab 130 may engage the exposed end 108 of the wire 102 to secure the connecting insert 112 on the wire 102. Optionally, the connecting insert 112 may include a plurality of the retention tabs 130 to secure the connecting insert 112 along the wire 102. For example, the retention tabs 130 may be provided on opposite sides of the wire 102 and may press against the wire 102 in opposite directions. The retention tabs 130 may be secured to the wire 102 by an interference fit. When the retention tabs 130 engage the wire 102, the connecting insert 112 does not slide along the wire 102. As such, the wire 102, with the shuttle assembly 110 fixed to the end 108, may be loaded into the terminal 140 as a unit without needing to separately hold the wire 102 and the shuttle assembly 110. The relative positions of the connecting insert 112 and the wire 102 do not change during loading into the terminal 140. Once the shuttle assembly 110 and the wire 102 are positioned in the terminal 140, the terminal 140 may be crimped around the shuttle assembly 110 and the wire 102, such as through a single crimping operation. Alternatively, instead of positioning the shuttle assembly 110 onto the wire 102, the shuttle assembly 110 may first be positioned within the terminal 140 and then the insulated wire may be urged into shuttle assembly 110.

The terminal 140 may be any type of terminal. In an exemplary embodiment, the terminal 140 is a crimp terminal configured to be crimped to the wire 102. The terminal 140 includes a wire barrel 142 connected to a base 144, such as a flat strap, panel, tab, pin, socket, or the like, which is configured to be electrically and mechanically connected to a component, device, or the like. The wire barrel 142 includes a chamber that defines an insert passage 146. The shuttle assembly 110 is inserted into the insert passage 146. For example, at least a portion of the connecting insert 112 is loaded into the insert passage 146. Optionally, at least a portion of the seal member 114 is loaded into the insert passage 146.

Once the shuttle assembly 110 and the wire 102 are loaded into the wire barrel 142, a crimping tool is used to crimp the wire barrel 142 to the assembly. During the crimping operation, the wire barrel 142 is crimped to the connecting insert 112 such that internal walls that define the crimping chamber compress into the connecting insert 112, which therefore compresses into the exposed end 108 of the conductor 104. The connecting insert 112 may move during crimping (for example, from the compression), which causes a wiping action along the internal walls of the wire barrel 142 and/or the exposed end 108 of the wire 102. Optionally, during the crimping operation, portions of the exposed end 108 of the conductor 104 may squeeze through the openings 122 of the connecting insert 112 and may contact the internal wall portions of the wire barrel 142. The crimping operation crimps the wire barrel 142 to the connecting insert 112 and crimps the connecting insert 112 to the conductor 104 of the wire 102. The crimping operation creates an electrical path between the exposed end 108 of the conductor 104 and the wire barrel 142, whether directly through contact between portions of the exposed end 108 that are squeezed through the openings 122, and/or through an intermediary contacting medium, such as the connecting insert 112. The crimping operation may stretch or extrude the wire exposing fresh wire material free of non-conductive oxides. The perforated insert may enhance the flow of oxide-free wire material and create a good electrical connection to the terminal.

The crimping tool also securely crimps an internal portion of the wire barrel 142 to the seal member 114, which, in turn, crimps around the end 108 of the insulating cover 106, thereby providing a fluid-tight seal therebetween. Accordingly, a single crimping operation may electrically and mechanically connect the terminal 140 to the wire 102 and, at the same time, provide a fluid-tight seal between the terminal 140 and the wire 102, as well as a fluid-tight seal between the seal member 114 and the insulating cover 106.

Figure 2:
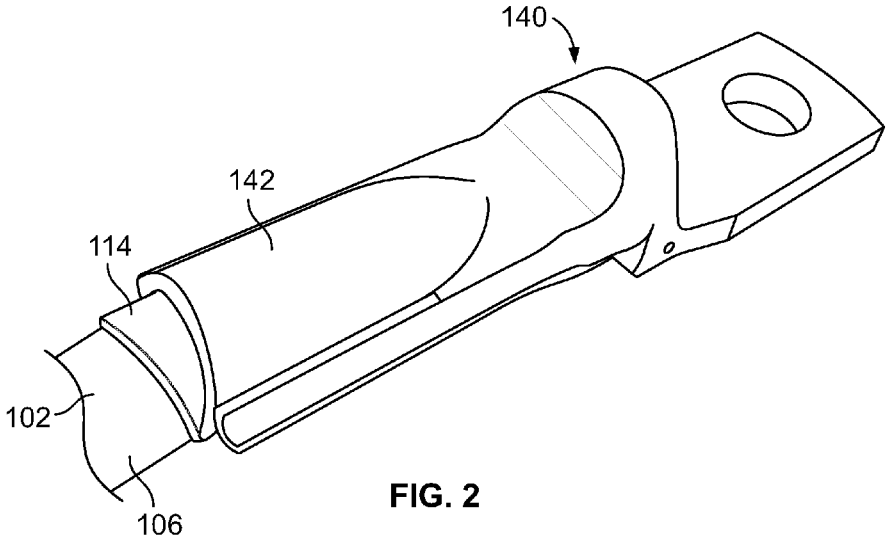
FIG. 2 is a perspective view of the terminal crimped to the wire assembly according to an embodiment of the present disclosure.

FIG. 2 is a perspective view of the terminal 140 crimped to the wire assembly, according to an embodiment of the present disclosure. A crimping tool is operated to form a crimp at an area that compressively crimps the wire barrel 142 to the connecting insert 112 (shown in FIG. 1), which, in turn, crimps the connecting insert 112 to the exposed end 108 of the conductor 104 (shown in FIG. 1), as well as compressively crimps a portion of the wire barrel 142 to the seal member 114, which, in turn, compressively crimps a portion of the seal member 114 to the insulating cover 106.

The wall 118 includes or defines an oxide-permeating mesh structure that is configured to break through aluminum oxides of the exposed end 108 of the conductor 104 of the wire 102 during crimping. For example, the openings 122 (shown in FIG. 1) may define the mesh structure. The openings 122 are configured to wipe against the conductor 104 of the wire 102 when the body 116 is crimped to the wire 102.

Figure 3:
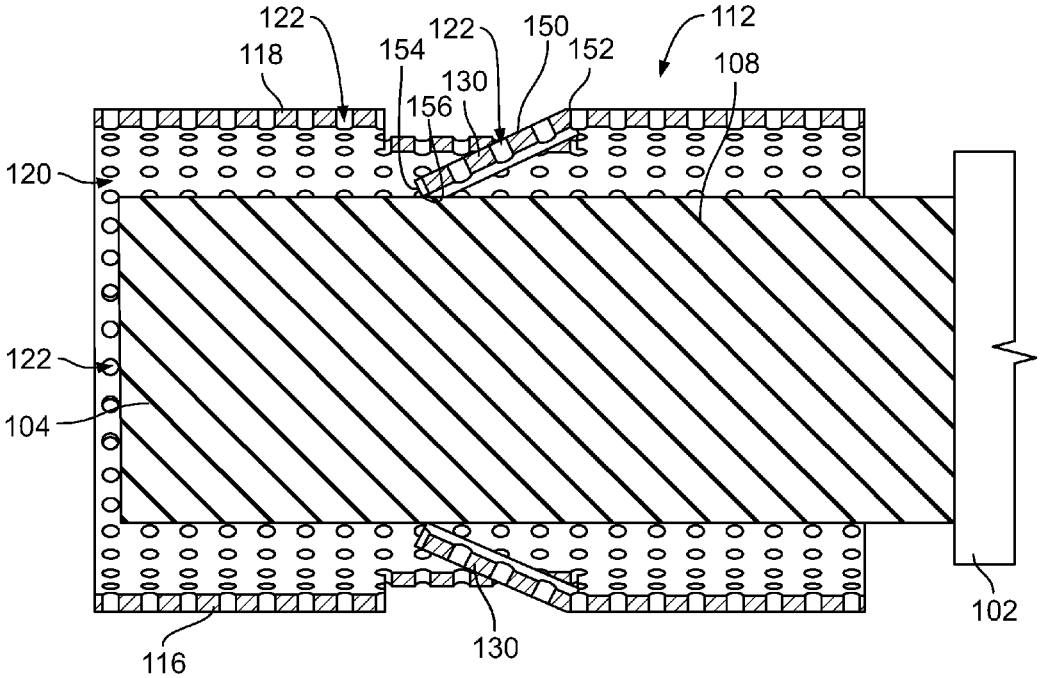
FIG. 3 is a cross-sectional view of a connecting insert of the wire assembly attached to a wire of the wire assembly according to an embodiment of the present disclosure.
Figure 4:
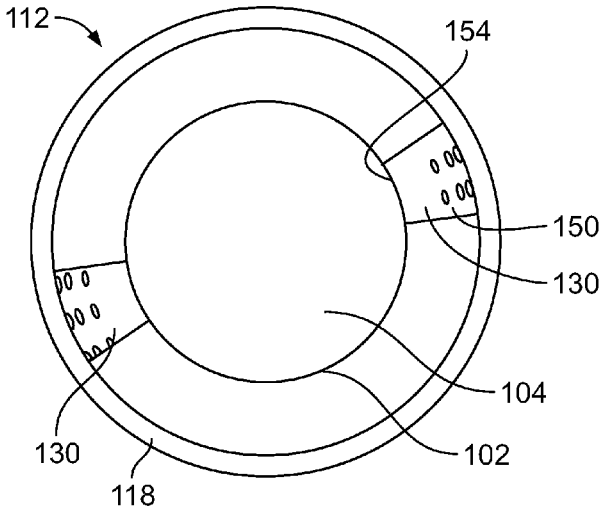
FIG. 4 is an end view of the connecting insert attached to the wire.

FIG. 3 is a cross-sectional view of the connecting insert 112 attached to the wire 102, according to an embodiment of the present disclosure. FIG. 4 is an end view of the connecting insert 112 attached to the wire. As described above, the connecting insert 112 includes the main body 116 having the cylindrical wall 118, and may include an end cap (not shown). The wall 118 defines the crimping chamber 120. The cylindrical wall 118 includes the plurality of openings 122, such as holes, perforations, slots, or the like. Optionally, instead of or in addition to the openings, protrusions may extend inwardly (toward the conductive wire) and/or outwardly (away from the conductive wire) from the cylindrical wall 118. The protrusions may be formed when the openings 122 are stamped into the wall 118. As noted above, when the connecting insert 112 is crimped into the exposed end 108 of the conductor 104, portions of the conductor 104 may squeeze through the openings 122.

The retention tabs 130 extend into the chamber 120 from the wall 118. The retention tabs 130 axially hold the connecting insert 112 along the exposed conductor 104 of the wire 102, such as by an interference fit, prior to being crimped to the wire 102. Any number of the retention tabs 130 may be provided, such as two retention tabs 130 provided on opposite sides of the wire 102. The retention tabs 130 oppose each other and press against the conductor 104 in opposite directions. However, in other embodiments, three retention tabs may be provided located approximately 120° apart from each other, four retention tabs may be provided located approximately 90° apart, or other configurations.

In the illustrated embodiment, the retention tabs 130 include cantilevered beams 150 extending from a fixed end 152 to a free end or distal end 154. The distal end 154 may dig into the conductor 104 of the wire 102 to resist axial pull-out of the wire 102 relative to the connecting insert 112. For example, when an edge 156 of the distal end 154 engages the conductor 104, rearward pulling of the wire 102 is restricted. Rearward pulling causes the beams 150 to dig further into the conductor 104. Optionally, the retention tabs 130 may be stamped out of the wall 118 and bent into the chamber 120. The retention tabs 130 may include some of the openings 122. Optionally, a diameter of the body 116 may change during crimping, such as by closing the wall 118 around the conductor 104 during crimping. For example, the body 116 may have an open seam that allows the diameter of the body 116 to change and/or to accommodate different diameter wires 102. The retention tabs 130 may be at least partially flattened out when the body 116 is crimped around the conductor 104. The openings 122 wipe against the conductor 104 when the connecting insert 112 is crimped to the wire 102.

Figure 5:
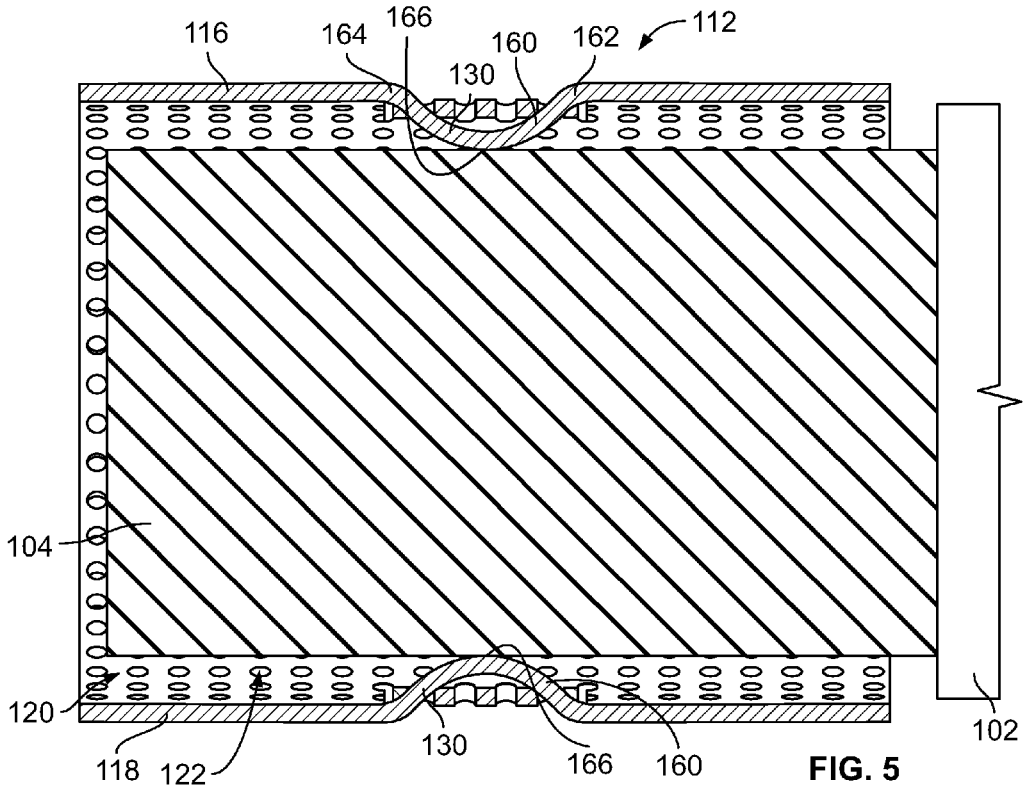
FIG. 5 is a cross-sectional view of the connecting insert attached to the wire according to an embodiment of the present disclosure.
Figure 6:
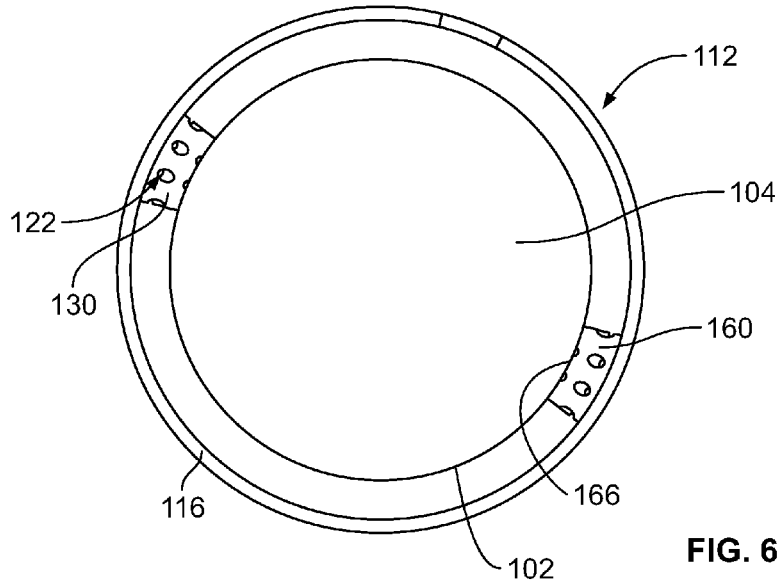
FIG. 6 is an end view of the connecting insert attached to the wire.

FIG. 5 is a cross-sectional view of the connecting insert 112 attached to the wire 102, according to an embodiment of the present disclosure. FIG. 6 is an end view of the connecting insert 112 attached to the wire. The retention tabs 130 extend into the chamber 120 from the wall 118. The retention tabs 130 axially hold the connecting insert 112 along the exposed conductor 104 of the wire 102, such as by an interference fit, prior to being crimped to the wire 102. Any number of the retention tabs 130 may be provided, such as two retention tabs 130 provided on opposite sides of the wire 102. The retention tabs 130 oppose each other and press against the conductor 104 in opposite directions. However, in other embodiments, three retention tabs may be provided located approximately 120° apart from each other, four retention tabs may be provided located approximately 90° apart, or other configurations.

In the illustrated embodiment, the retention tabs 130 include bumps 160 extending between first and second ends 162, 164. The ends 162, 164 are both fixed to the wall 118. The bumps 160 are stamped out of the wall and formed into the chamber 120. The bumps 160 extend to a mating interface 166, which may be approximately centered between the ends 162, 164. The mating interfaces 166 engage the conductor 104. The conductor 104 may be held between the mating interfaces 166 by an interference fit to resist axial movement of the connecting insert 112 along the wire 102. The retention tabs 130 may include some of the openings 122. Optionally, a diameter of the body 116 may change during crimping, such as by closing the wall 118 around the conductor 104 during crimping. The retention tabs 130 may be at least partially flattened out when the body 116 is crimped around the conductor 104. The openings 122 wipe against the conductor 104 when the connecting insert 112 is crimped to the wire 102.

Figure 7:
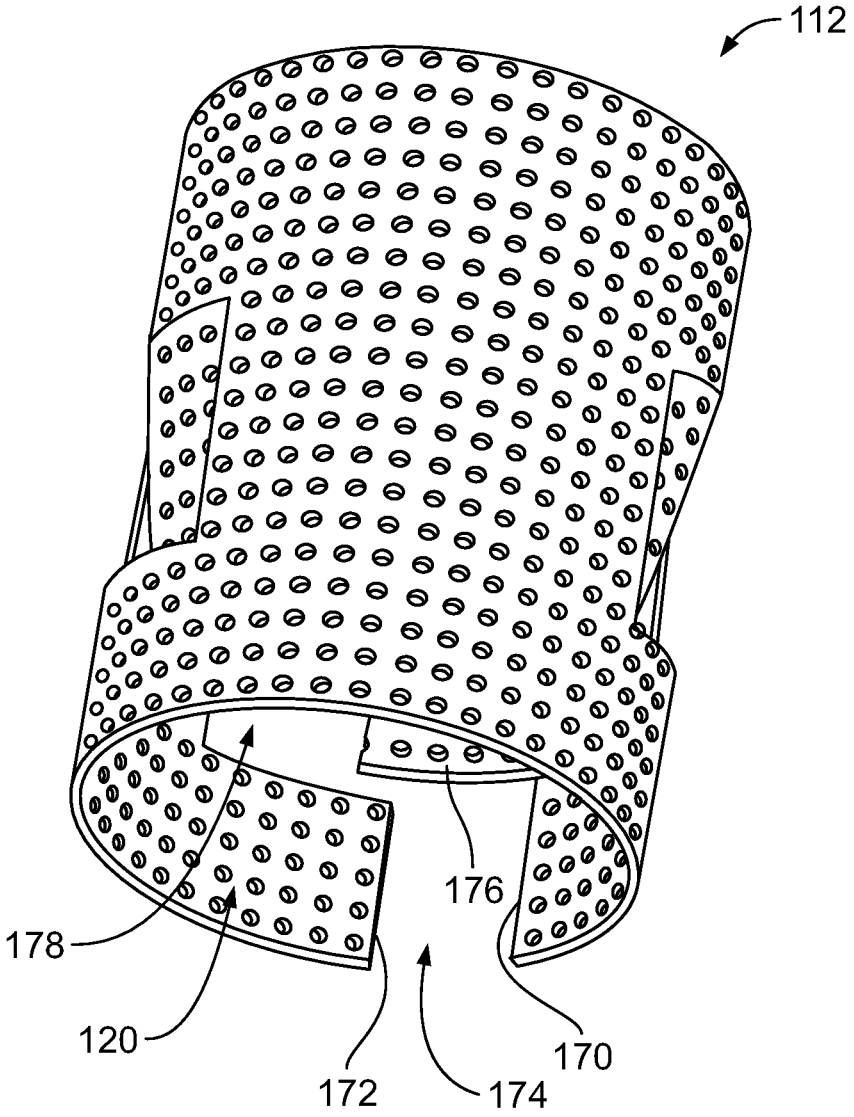
FIG. 7 is a perspective view of the connecting insert.

FIG. 7 is a perspective view of the connecting insert 112. The connecting insert 112 may be formed from a planar sheet that is rolled such that opposing edges 170, 172 face each other at a seam 174. One edge 170 of the connecting insert 112 may include a tab 176 that is configured to fit into a reciprocal slot 178 formed in the other edge 172. In this manner, the connecting insert 112 may form a cylindrical sleeve. Optionally, the seal member may fit over a portion of the connecting insert 112 to securely maintain the shape. The seam 174 may be open to provide an increased diameter for the connecting insert 112, such as for loading the wire 102 (FIG. 1) into the chamber 120. The seam 174 may be closed around the wire 102, such as during the crimping process.

Referring to FIGS. 1-7, embodiments of the present disclosure may provide simple and efficient systems and methods for securely connecting a wire assembly to a terminal. Further, embodiments of the present disclosure may provide retention tabs for securing the connecting insert to the wire for manipulation and handling, such as during loading of the wire assembly into the terminal.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A terminal assembly comprising:

a terminal having a wire barrel and a mating segment configured to be mated to a mating component; and a shuttle assembly configured to be coupled to an end of a wire, the shuttle assembly comprising a connecting insert defining a wire chamber configured to receive an exposed conductor of the wire, the connecting insert includes a perforated structure having a pattern of openings, the connecting insert having a retention tab extending into the wire chamber, the retention tab being deflectable and configured to be spring biased against and interfere with and retain the wire in the wire chamber, wherein the connecting insert is received in the wire barrel of the terminal and the connecting insert is configured to be crimped between the wire barrel of the terminal and the exposed conductor of the wire when the wire barrel is crimped around the connecting insert and the wire such that the perforated structure wipes against the conductor of the wire when the perforated structure is crimped to the wire.

2. The terminal assembly of claim 1, wherein a single crimp crimps the wire barrel of the terminal to the connecting insert and crimps the connecting insert to the exposed end of the conductive wire.

3. The terminal assembly of claim 1, wherein the retention tab axially holds the connecting insert along the exposed conductor of the wire by an interference fit prior to being crimped to the wire.

4. The terminal assembly of claim 1, wherein the connecting insert includes a plurality of the retention tabs.

5. The terminal assembly of claim 4, wherein the retention tabs oppose each other and press against the conductor in opposite directions.

6. The terminal assembly of claim 1, wherein the retention tab is a beam extending to a distal end, the distal end being configured to dig into the conductor of the wire to resist axial pull-out of the wire relative to the connecting insert.

7. The terminal assembly of claim 1, wherein the retention tab is a bump fixed at both ends, the retention tab having a mating interface approximately centered between the ends.

8. The terminal assembly of claim 1, wherein the connecting insert includes a body having a wall surrounding the wire chamber, the wall including the perforated structure that is configured to break through aluminum oxides of the exposed end of the conductor of the wire during crimping.

9. The terminal assembly of claim 1, wherein the connecting insert includes a body having a wall surrounding the wire chamber, the wall having a plurality of openings therethrough defined by edges configured to wipe against the conductor of the wire when the body is crimped to the wire.

10. The terminal assembly of claim 9, wherein the retention tab includes a plurality of the openings.

11. A terminal assembly comprising:

a terminal having a wire barrel and a mating segment configured to be mated to a mating component; and a shuttle assembly configured to be coupled to an end of a wire, the shuttle assembly comprising a connecting insert and a seal member extending from the connecting insert, the seal member being configured to be coupled to an insulating cover of the wire, the connecting insert defining a wire chamber configured to receive an exposed conductor of the wire forward of the insulating cover, the connecting insert includes a perforated structure having a pattern of openings, the connecting insert having a retention tab extending into the wire chamber, the retention tab being deflectable and configured to be spring biased against and interfere with and retain the wire in the wire chamber;

wherein the connecting insert and the seal member are received in the wire barrel of the terminal, the connecting insert is configured to be crimped between the wire barrel of the terminal and the exposed conductor of the wire when the wire barrel is crimped around the connecting insert and the wire such that the perforated structure wipes against the conductor of the wire when the perforated structure is crimped to the wire, and the seal member is configured to be crimped between the wire barrel of the terminal and the insulating cover of the wire when the wire barrel is crimped around the seal member and the wire.

12. The terminal assembly of claim 11, wherein the connecting insert is integrally formed with the seal member.

13. The terminal assembly of claim 11, wherein a single crimp crimps the connecting insert to the exposed end of the conductive wire and the seal member to the insulating cover.

14. The terminal assembly of claim 11, wherein a single crimp crimps the wire barrel of the terminal to the connecting insert and crimps the connecting insert to the exposed end of the conductive wire.

15. The terminal assembly of claim 11, wherein the retention tab axially holds the connecting insert along the exposed conductor of the wire by an interference fit prior to being crimped to the wire.

16. The terminal assembly of claim 11, wherein the retention tab is a beam extending to a distal end, the distal end being configured to dig into the conductor of the wire to resist axial pull-out of the wire relative to the connecting insert.

17. The terminal assembly of claim 11, wherein the retention tab is a bump fixed at both ends, the retention tab having a mating interface approximately centered between the ends.

18. The terminal assembly of claim 11, wherein the connecting insert includes a body having a wall surrounding the wire chamber, the wall including the perforated structure that is configured to break through aluminum oxides of the exposed end of the conductor of the wire during crimping.

19. The terminal assembly of claim 11, wherein the connecting insert includes a body having a wall surrounding the wire chamber, the wall having a plurality of openings therethrough defined by edges configured to wipe against the conductor of the wire when the body is crimped to the wire.

20. A connecting insert configured to be crimped to a wire, the connecting insert comprising:

a body including a perforated structure having a pattern of openings having a wall defining a wire chamber configured to receive an exposed conductor of the wire, the wall of the perforated structure having a plurality of openings therethrough defined by edges enclosing the openings, the edges configured to wipe against a conductor of the wire when the perforated structure of the body is crimped to the wire; and retention tabs extending from the wall into the wire chamber, the retention tabs being deflectable and configured to be spring biased against and interfere with and retain the wire in the wire chamber until the body is crimped to the wire, the retention tabs being compressed against the wire when the body is crimped to the wire.

* * * * *